US007405544B2

(12) United States Patent
Yeh et al.

(10) Patent No.: US 7,405,544 B2
(45) Date of Patent: Jul. 29, 2008

(54) VOLTAGE REGULATING CIRCUIT FOR UNINTERRUPTIBLE POWER SUPPLY

(75) Inventors: Shou-Ting Yeh, Taipei (TW); Lien-Hsun Ho, Taipei (TW); Yuan-Liang Hsu, Taipei (TW)

(73) Assignee: Cyber Power System Inc., Taipei (TW)

( * ) Notice: Subject to any disclaimer, the term of this patent is extended or adjusted under 35 U.S.C. 154(b) by 220 days.

(21) Appl. No.: 11/475,017

(22) Filed: Jun. 27, 2006

(65) Prior Publication Data

US 2007/0145829 A1 Jun. 28, 2007

(30) Foreign Application Priority Data

Dec. 26, 2005 (TW) ..... 94222643 U

(51) Int. Cl.
*G05F 1/26* (2006.01)

(52) U.S. Cl. ..... 323/263; 323/255; 363/137; 363/133; 363/142; 361/8; 361/13

(58) Field of Classification Search ..... 323/215, 323/218, 262, 263, 343, 225; 363/133, 137, 363/142, 148; 307/87, 105, 134, 135; 361/8, 361/13

See application file for complete search history.

(56) References Cited

U.S. PATENT DOCUMENTS 4,717,889 A * 1/1988 Engelmann ..... 330/297
4,745,352 A * 5/1988 McGuire ..... 323/263
4,791,348 A * 12/1988 McGuire et al. ..... 323/263
5,383,109 A * 1/1995 Maksimovic et al. ..... 323/222
5,883,503 A * 3/1999 Lace ..... 323/259

* cited by examiner

*Primary Examiner*—Rajnikant B Patel
(74) *Attorney, Agent, or Firm*—Muncy, Geissler, Olds & Lowe, PLLC

(57) ABSTRACT

A voltage regulating circuit has a first switch, a transformer and a second switch. The first switch has an input node, a first node and a second node. The transformer is connected to the switches has a first coil and a second coil. The first coil and the second coil respectively have an end, and the second coil is connected to the first coil in series at a node. The node between the first and second coils is connected to the second node of the first switch. The second switch is connected to the transformer and has a first node, a second node and an output node. The first node is connected to the end of the first coil. The second node is connected to the first node of the first switch. The transformer will not heat up when the transformer needs not to be used.

7 Claims, 2 Drawing Sheets

VOLTAGE REGULATING CIRCUIT FOR UNINTERRUPTIBLE POWER SUPPLY

BACKGROUND OF THE INVENTION

1. Field of the Invention

The present invention relates to a voltage regulating circuit, and more particularly to a voltage regulating circuit for an uninterruptible power supply (UPS).

2. Description of Related Art

With reference to FIG. 2, a conventional voltage regulating circuit for an uninterruptible power supply (UPS) comprises a transformer (10) and a switch (23). The transformer (10) is connected to AC power inputs L and N and comprises a first coil (11) and a second coil (12) connected in series. The first coil (11) is formed with multiple turns and has an end. The second coil (12) is formed with multiple turns with two ends respectively connected to the AC power inputs L and N. The switch (23) is connected to the transformer (10) and has a normal close node (232), a normal open node (233) and a common node (231). The normal close node (232) is connected to the end of the first coil (11). The normal opened node (233) is connected to the AC power input L through the transformer (10). When the input voltage is at a normal level, the common node (231) of the switch (23) is switched to connect to the normal close node (232). The input voltage passes through the first and second coil (11, 12) of the transformer (10) and the switch (23) as an output voltage. When input voltage is at a low level, the common node (231) of the switch (23) is switched to connect to the normal open node (233). The input voltage passes through the second coil (12) of the transformer (10) and the switch (23) to be transformed into an output voltage. The coupling ratio of the output voltage to the input voltage is the ratio of the sum of turns of the two coils (11)(12) to the number of turns of the second coil (12). Therefore the output voltage is higher than the input voltage in voltage level.

However, the input voltage still passes through the transformer (10) even when the input voltage is at a normal level. When the input voltage passes through the transformer (10), the transformer (10) heats up and may be damaged by constantly heating up.

To overcome the shortcomings, the present invention provides a voltage regulating circuit for an UPS to mitigate or obviate the aforementioned problems.

SUMMARY OF THE INVENTION

The main objective of the invention is to provide a voltage regulating circuit for an uninterruptible power supply (UPS).

A voltage regulating circuit in accordance with the present invention comprises a first switch, a transformer and a second switch. The first switch has an input node, a first node and a second node. The transformer is connected to the first switch and comprises a first coil and a second coil. The first coil and the second coil respectively have an end, and the second coil is connected to the first coil in series at a node. The node between the first and second coils is connected to the second node of the first switch. The second switch is connected to the transformer and has a first node, a second node and an output node. The first node is connected to the end of the first coil. The second node is connected to the first node of the first switch. The first nodes of the first and second switches are normal close. The second nodes of the first and second switches are normal open.

Other objectives, advantages and novel features of the invention will become more apparent from the following detailed description when taken in conjunction with the accompanying drawings.

DETAILED DESCRIPTION OF PREFERRED EMBODIMENT

Figure 1:
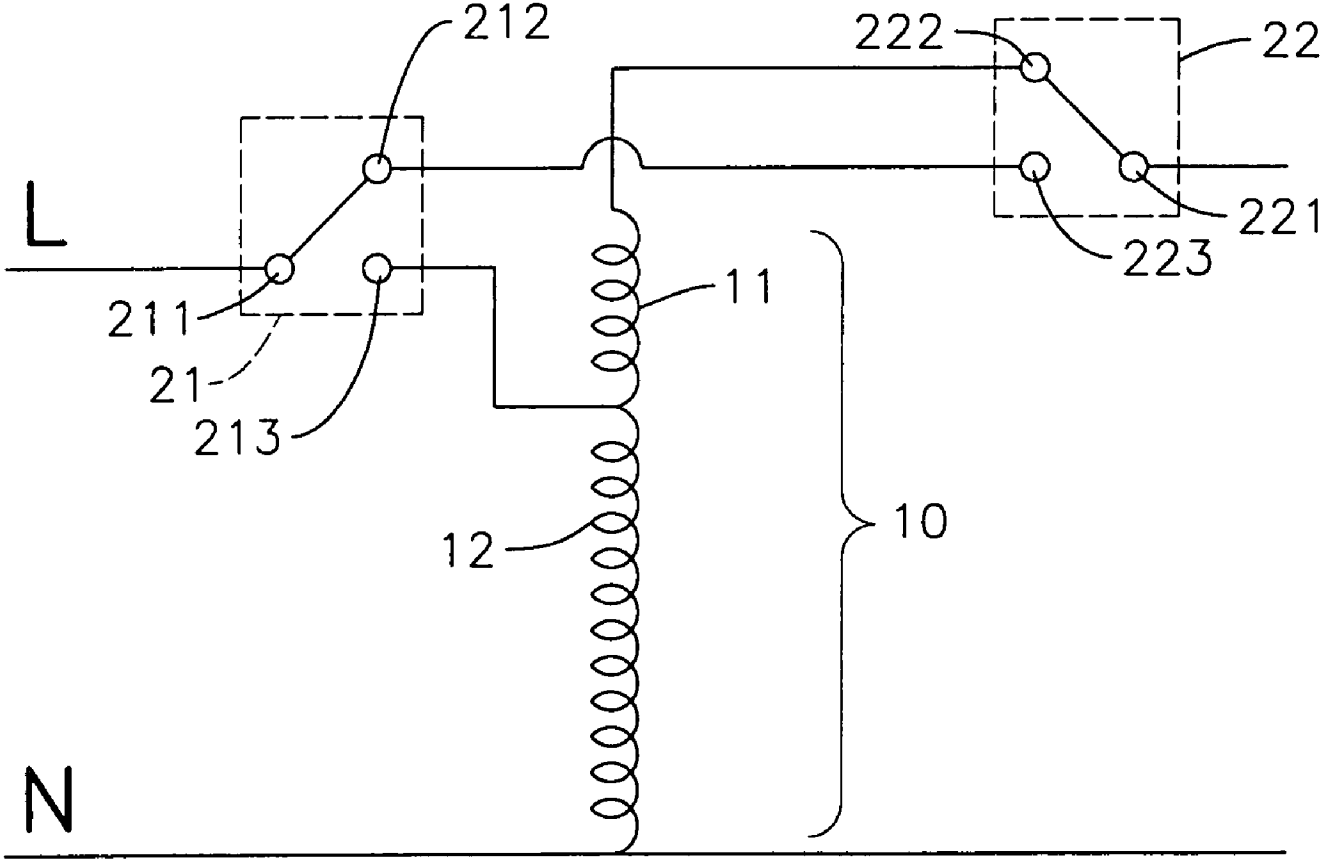
FIG. 1 is a circuit diagram of a voltage regulating circuit for an uninterruptible power supply (UPS) in accordance with the present invention.
Figure 2:
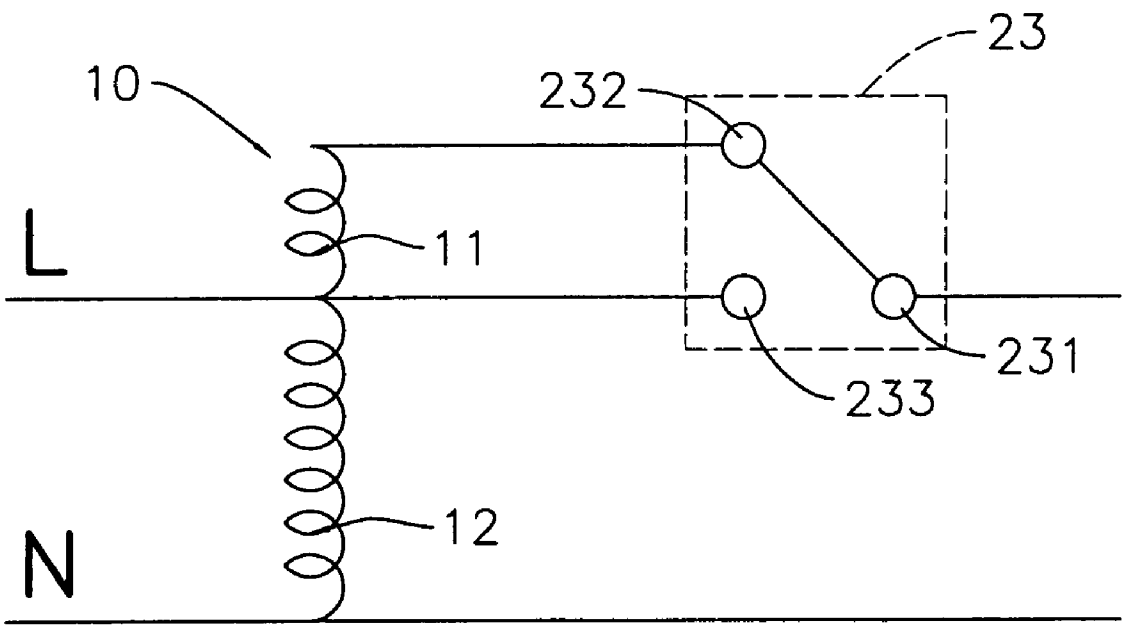
FIG. 2 PRIOR ART
FIG. 2 is circuit diagram of a conventional voltage regulating circuit for UPS.

With reference to FIG. 1, a voltage regulating circuit for an uninterruptible power supply (UPS) in accordance with the present invention is connected to AC power inputs L and N and comprises a first switch (21), a transformer (10) and a second switch (22).

The first switch (21) is connected to the AC power input L and has an input node (211), a first node (212) and a second node (213).

The input node (211) is connected to the AC power input L and can be a common node. The first node (212) can be a normal close node. The second node (213) can be a normal open node.

The transformer (10) is connected to the AC power input N and the first switch (21) and comprises a first coil (11) and a second coil (12).

The first coil (11) and the second coil (12) are respectively formed with multiple turns and respectively have an end, and the second coil (12) is connected to the first coil (11) in series at a node. The end of the second coil (12) is connected to the AC power input N. The node between the first and second coils (11, 12) is connected to the second node (213) of the first switch (21).

The second switch (22) is connected to the first switch (21) and the transformer (10) and has a first node (222), a second node (223) and an output node (221). The first node (222) is connected to the end of the first coil (11) and can be a normal close node. The second node (223) is connected to the first node (212) of the first switch (21) and can be a normal open node.

When input voltage is at a normal level, the input node (211) and the output node (221) are switched to respectively connect to the first node (212) of the first switch (21) and the second node (223) of the second switch (22). The input voltage is directly transmitted through the two switches (21, 22) as the output voltage.

When input voltage is at a low level, the input node (211) and the output node (221) are switched to respectively connect to the second node (213) of the first switch (21) and the first node (222) of the second switch (22). The ratio of the output voltage to the input voltage is the ratio of the sum of turns of the first and the second coils (11, 12) to turns of the second coil (12) and thereby the output voltage is at a higher level than the input voltage.

With such a voltage regulating circuit, the input voltage does not need to pass through the transformer (10) when input voltage is at a normal level and the transformer (10) will not heat up when the transformer (10) needs not to be used. Therefore, the present invention decreases the chance to damage the transformer (10) and can lengthen the span life of the transformer (10).

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A voltage regulating circuit for an uninterruptible power supply (UPS) comprising:

a first switch adapted to connected to the AC power and having an input node connected to the AC power to receive an input voltage;

a first node; and a second node;

a transformer adapted to connected to the AC power and the first switch and comprising a first coil formed with multiple turns and having an end; and a second coil formed with multiple turns, connected to the first coil in series at a node and having an end connected to the AC power input N, wherein the node between the first and second coils is connected to the second node of the first switch; and a second switch connected to the transformer to directly transmit the input voltage and having a first node connected to the end of the first coil;

a second node connected to the first node of the first switch; and an output node.

2. The circuit as claimed in claim 1, wherein the input node of the first switch is a common node.

3. The circuit as claimed in claim 1, wherein the first node of the first switch is a normal closed node.

4. The circuit as claimed in claim 1, wherein the second node of the first switch is a normal opened node.

5. The circuit as claimed in claim 1, wherein the first node of the second switch is a normal closed node.

6. The circuit as claimed in claim 1, wherein the second node of the second switch is a normal opened node.

7. The circuit as claimed in claim 1, wherein the input node of the second switch is a common node.

* * * * *